US008038324B2

(12) United States Patent
Chen

(10) Patent No.: US 8,038,324 B2
(45) Date of Patent: Oct. 18, 2011

(54) WATERPROOF LIGHTING FIXTURE

(76) Inventor: Hui Yu Chen, Taichung County (TW)

( * ) Notice: Subject to any disclaimer, the term of this patent is extended or adjusted under 35 U.S.C. 154(b) by 266 days.

(21) Appl. No.: 12/435,456

(22) Filed: May 5, 2009

(65) Prior Publication Data

US 2010/0214785 A1 Aug. 26, 2010

(30) Foreign Application Priority Data

Feb. 23, 2009 (TW) ..... 98105643 A

(51) Int. Cl.
*F21V 29/00* (2006.01)

(52) U.S. Cl. ... 362/267; 362/222; 362/240; 362/249.02; 362/294

(58) Field of Classification Search ..... 362/222, 362/223, 225, 238, 240, 249.01, 249.02, 362/267, 294, 373
See application file for complete search history.

(56) References Cited

U.S. PATENT DOCUMENTS 7,553,051 B2 * 6/2009 Brass et al. ..... 362/373
* cited by examiner

*Primary Examiner* — John A Ward
(74) *Attorney, Agent, or Firm* — Kirschstein, et al.

(57) ABSTRACT

A waterproof lighting fixture includes a transparent tubular enclosure having two open ends and an inner peripheral wall that defines an inner hole. A lamp device is disposed in the inner hole, and includes a lamp seat, a LED light source module, a reflector component, a LED driver, and a power cable. The lamp seat has a heat-dissipating peripheral wall that is disposed around the lamp seat, that defines a compartment having an upper end opening, and that has an inner surface. A heat-dissipating base wall is disposed on the inner surface, and has a bottom surface. At least one heat-dissipating connecting wall is connected between the bottom surface and the inner surface. First and second waterproof devices are disposed for sealing the open ends of the enclosure, respectively.

8 Claims, 5 Drawing Sheets

WATERPROOF LIGHTING FIXTURE

CROSS-REFERENCE TO RELATED APPLICATION

This application claims priority of Taiwanese Application No. 098105643, filed on Feb. 23, 2009.

BACKGROUND OF THE INVENTION

1. Field of the Invention

The invention relates to a lighting fixture, more particularly to a waterproof lighting fixture capable of dissipating heat generated by a light source module thereof.

2. Description of the Related Art

A conventional waterproof lighting fixture employs fluorescent lamps as a light source. The service life of the fluorescent lamps, however, is only about 6,000 hours, thus resulting in an increase in cost during use. Furthermore, the waterproof lighting fixture cannot focus light effectively, so that sidelight may exist during use.

In order to alleviate the above drawbacks, Taiwanese Patent Publication No. 582508 discloses a waterproof lighting fixture, in which the fluorescent lamps are replaced by light emitting diodes (LED), thus reducing operating costs and power consumption. However, the waterproof lighting fixture also cannot focus light and lacks a heat-dissipating ability.

SUMMARY OF THE INVENTION

Therefore, the object of the present invention is to provide a waterproof lighting fixture that can focus light effectively and that has a heat-dissipating ability.

According to the present invention, there is provided a waterproof lighting fixture comprising a tubular transparent enclosure extending along an axial direction. The transparent enclosure has two open ends opposite to each other along the axial direction and an inner peripheral wall that defines an inner hole therein. A lamp device is disposed in the inner hole of the transparent enclosure. The lamp device includes a lamp seat disposed along the axial direction, a LED light source module, a reflector component, a LED driver electrically connected to the LED light source module, and a power cable electrically connected to the LED driver. The lamp seat has a heat-dissipating peripheral wall that is disposed around the lamp seat, that defines a compartment having an upper end opening, that has an inner surface, and that extends along the axial direction. A heat-dissipating base wall is disposed on the inner surface of the heat-dissipating peripheral wall, and has a bottom surface. At least one heat-dissipating connecting wall is connected between the bottom surface of the heat-dissipating base wall and the inner surface of the heat-dissipating peripheral wall and extends along the axial direction. The heat-dissipating base wall partitions the compartment into an upper compartment portion communicated with the upper end opening and a lower compartment portion. The LED light source module is disposed on and above the heat-dissipating base wall and in the upper compartment portion, and extends along the axial direction. The reflector component includes a bottom wall having two side edges extending along the axial direction. The bottom wall is formed with at least one through hole permitting the LED light source module to extend therethrough, and two side walls extending respectively and upwardly from and along the two side edges of the bottom wall. Each of the side walls has a reflecting surface that faces toward the other of the side walls. The reflecting surfaces of the side walls extend upwardly and inclinedly relative to the bottom wall such that a distance between the reflecting surfaces increases in a direction away from the bottom wall. The LED driver is disposed on the heat-dissipating base wall. A first waterproof device and a second waterproof device are disposed for sealing the open ends of the tubular transparent enclosure, respectively. The power cable extends through the first waterproof device. The lamp device is positioned between the first and second waterproof devices.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
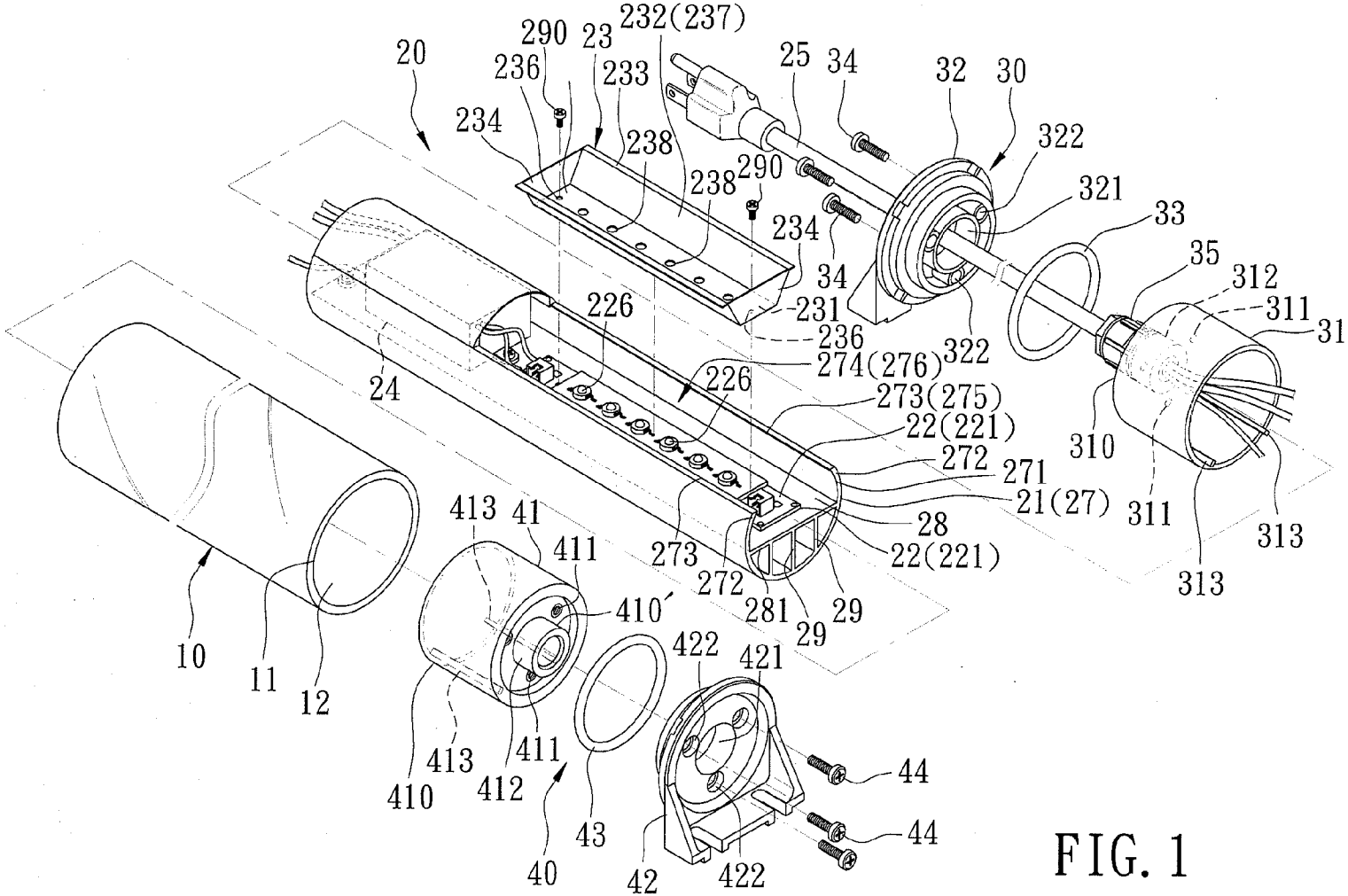
FIG. 1 is a partly exposed perspective view of a preferred embodiment of a waterproof lighting fixture according to the present invention.
Figure 2:
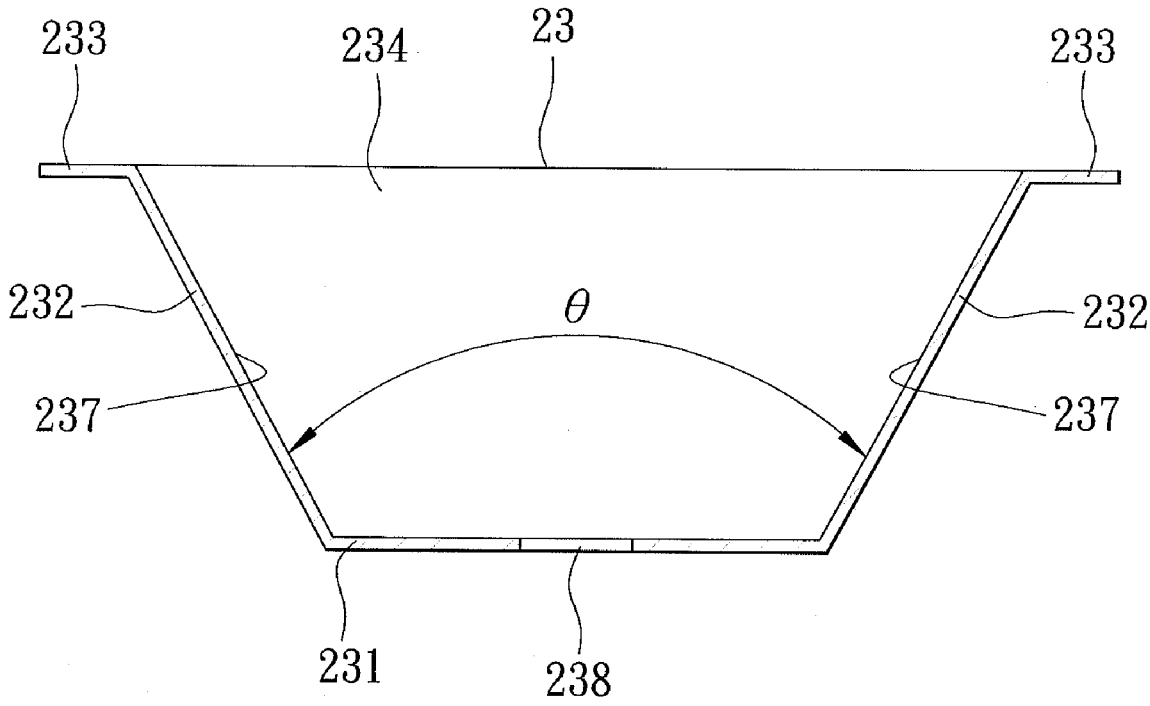
FIG. 2 is a sectional view of a reflector component of the first preferred embodiment according to the present invention.
Figure 3:
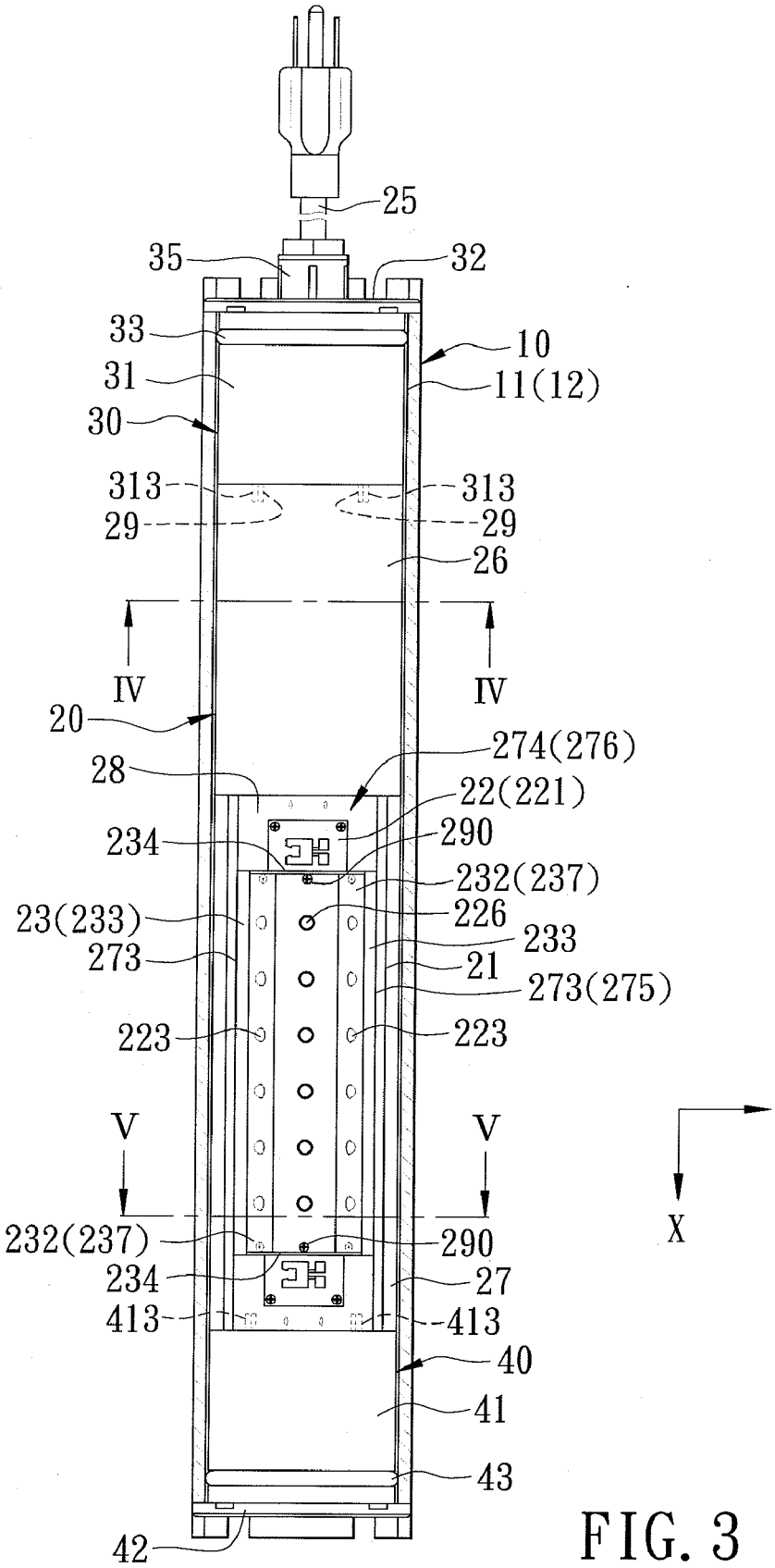
FIG. 3 is a partly sectional schematic top view of the waterproof lighting fixture of the preferred embodiment according to the present invention.

A preferred embodiment of a waterproof lighting fixture according to the present invention is shown in FIGS. 1 to 3. The waterproof lighting fixture comprises a tubular transparent enclosure 10, a lamp device 20, a first waterproof device 30, and a second waterproof device 40. The first and second waterproof devices 30, 40 are disposed respectively at two opposite ends of the enclosure 10.

The tubular transparent enclosure 10 extends along an axial direction (X) and has two open ends opposite to each other along the axial direction (X), and an inner peripheral surface 11 that defines an inner hole 12 therein. The LED lamp device 20 is disposed in the inner hole 12 of the transparent enclosure 10. The first waterproof device 30 and the second waterproof device 40 are disposed for sealing the open ends of the tubular transparent enclosure 10, respectively. The lamp device 20 includes a lamp seat 21 disposed along the axial direction (X), a LED light source module 22, a reflector component 23, a LED driver 24 electrically connected to the LED light source module 22, a power cable 25 electrically connected to the LED driver 24, a protection cover 26, and two screws 290.

Figure 5:
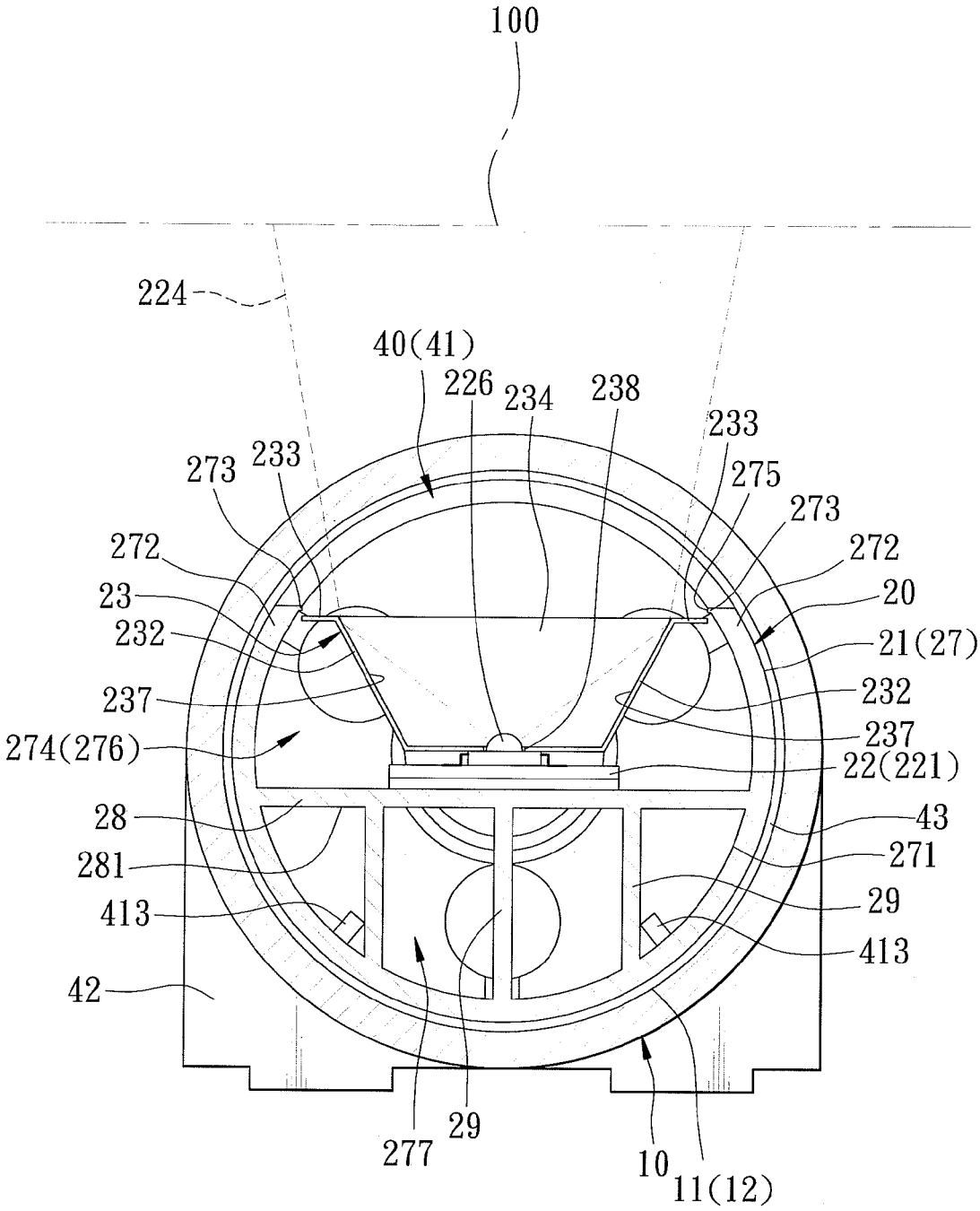
FIG. 5 is a sectional view taken along line V-V in FIG. 3.

As further shown in FIG. 5, the lamp seat 21 has a heat-dissipating peripheral wall 27 that is disposed around the lamp seat 21, that defines a compartment 274 having an upper end opening 275, that has an inner surface 271, and that extends along the axial direction (X). A heat-dissipating base wall 28 is disposed on the inner surface 271 of the heat-dissipating peripheral wall 27 and has a bottom surface 281. The heat-dissipating base wall 28 partitions the compartment 274 into an upper compartment portion 276 communicated with the upper end opening 275 and a lower compartment portion 277.

A plurality of spaced-apart heat-dissipating connecting walls 29 extend uprightly between the bottom surface 281 of the heat-dissipating base wall 28 and the inner surface 271 of the heat-dissipating peripheral wall 27. The heat-dissipating connecting walls 29 are disposed in the lower compartment portion 277, and extend along the axial direction (X).

The LED light source module 22 is disposed on and above the heat-dissipating base wall 28 and in the upper compartment portion 276 and extends along the axial direction (X).

In the preferred embodiment, the LED light source module 22 includes a circuit board 221 disposed on the heat-dissipating base wall 28 and electrically connected to the LED driver 24, and a plurality of LED light sources 226 disposed on the circuit board 221 along the axial direction (X).

The reflector component 23 is disposed on the heat-dissipating base wall 28. The reflector component 23 includes a bottom wall 231 having two side edges extending along the axial direction (X). The bottom wall 231 is formed with a plurality of through holes 238 that are circular and that are spaced apart from each other along the axial direction (X) and that permit the LED light source module 22 to extend fittingly therethrough. Two side walls 232 extend respectively and upwardly from and along the two side edges of the bottom wall 231. Each of the side walls 232 has a reflecting surface 237 that faces toward the other of the side walls 232.

The reflecting surfaces 237 of the side walls 232 extend upwardly and inclinedly relative to the bottom wall 231 such that a distance between the reflecting surfaces 237 increases in a direction away from the bottom wall 231. The reflecting surfaces 237 of the side walls 232 define an angle θ therebetween that preferably ranges from 80° to 120°. Each of the side walls 232 and the bottom wall 231 of the reflector component 23 has first and second ends opposite to each other along the axial direction (X).

The reflector component 23 further includes two end walls 234 connected to the side walls 232 and the bottom wall 231 at a respective one of the first and second ends. Each of the side walls 232 of the reflector component 23 has a distal edge opposite to the bottom wall 231. The reflector component 23 further includes two extension walls 233 each extending horizontally from the distal edge of a respective one of the side walls 232 along the axial direction (X) and away from the other one of the side walls 232.

The bottom wall 231 is further formed with a pair of fastener holes 236 that are spaced apart from each other along the axial direction (X). The through holes 238 are disposed between the fastener holes 236. Each of the through holes 238 permits a respective one of the LED light sources 226 to engage fittingly therein. The screws 290 extend respectively through the fastener holes 236 and are threaded into the heat-dissipating base wall 28 to secure the reflector component 23 to the circuit board 221. In the preferred embodiment, the reflector component 23 is made of stainless steel.

The LED driver 24 is disposed on the heat-dissipating base wall 28. The heat-dissipating peripheral wall 27 has two spaced-apart ends 272 extending along the axial direction (X), and two slide rail portions 273 disposed respectively at the ends 272 of the heat-dissipating peripheral wall 27. The protection cover 26 has two slots 261 that respectively and movably engage the slide rail portions 273. The protection cover 26 covers the LED driver 24.

The first and second waterproof devices 30, 40 include positioning sleeves 31, 41 mounted in the enclosure 10, respectively, abutment members 32, 42, a first and a second waterproof washers 33, 43 clamped between the positioning sleeves 31, 41 and the abutment member 32, 42, respectively, a plurality of screws 34, 44, and a waterproof plug 35 extending into the positioning sleeve 31 and through the abutment member 32.

The positioning sleeves 31, 41 have sleeve bodies 310, 410 formed respectively with flanges (not shown), 410' extending radially and inwardly therefrom, a plurality of screw holes 311, 411 formed respectively in the flanges 410' of the sleeve body 310, 410, plug-engaging portions 312, 412 extending respectively from the flanges 410' of the sleeve body 310, 410 and through the abutment members 32, 42, and two pair of positioning blocks 313, 413 extending axially into the lamp seat 21, respectively. The waterproof plug 35 extends into the plug-engaging portion 312. The abutment members 32, 42 have a plurality of through holes 322, 422 corresponding respectively to the screw holes 311, 411, and engaging holes 321, 421 permitting the waterproof plug 35 and the plug-engaging portions 312, 412 to extend therethrough.

The screws 34, 44 extend respectively through the through holes 322, 422 in the abutment members 32, 42 and engage respectively the screw holes 311, 411 in the positioning sleeves 31, 41, thereby pressing the first and second waterproof washers 33, 43 against the inner peripheral surface 11 of the enclosure 10. As such, a watertight seal is established among the abutment members 32, 42, the positioning sleeves 31, 41, and the enclosure 10.

The positioning blocks 313, 413 extend respectively into the lower compartment portion 277 of the compartment 274 of the lamp seat 21, and abut respectively against two of the heat-dissipating connecting walls 29 such that the two heat-dissipating connecting walls 29 are located respectively between the positioning blocks 313, 413, thereby positioning the lamp seat 21 within the enclosure 10.

The power cable 25 extends through the abutment member 32, the first waterproof washer 33, the waterproof plug 35, and the positioning sleeve 31. Therefore, the lamp seat 21 is fixed between the positioning sleeves 31, 41 of the first and second waterproof devices 30, 40.

Figure 4:
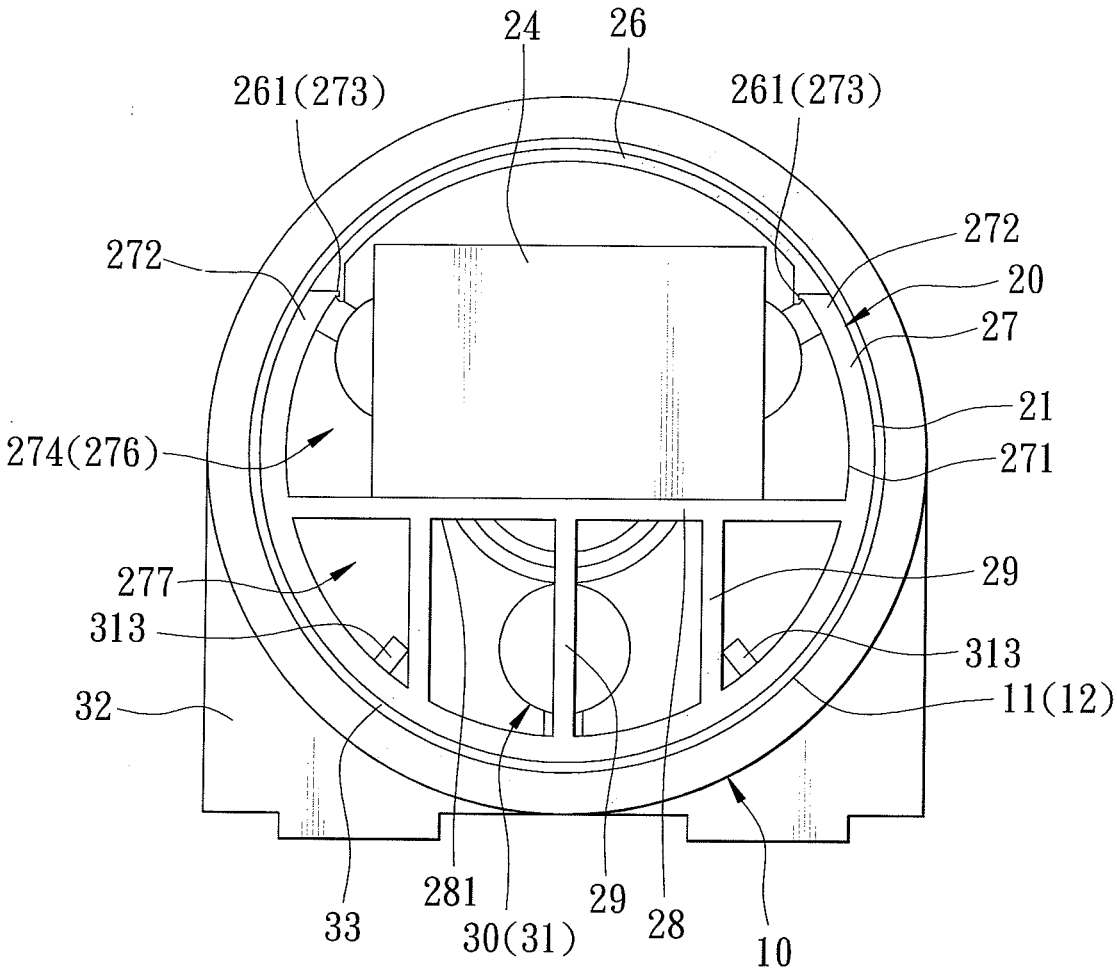
FIG. 4 is a schematic sectional view taken along line VI-VI in FIG. 3.

As shown in FIG. 3, when the light sources 226 are turned on, six mirror images 223 (see FIG. 3) of the light sources 226 are formed by reflection on each of the reflecting surfaces 237 of the side walls 232, i.e., six mirror images 223 of the light sources 226 appear on each of the reflecting surfaces 232. Consequently, a light 224 (see FIG. 4) projected by the light sources 226 can provide a projection region 100 (see FIG. 4) that is suitable for large region illumination due to reflection by the reflection surfaces 237. Additionally, heat generated by the LED light source module 22 can be dissipated through the heat-dissipating base wall 28 to the heat-dissipating peripheral wall 27, and to the heat-dissipating connecting walls 29.

To sum up, the reflector component 23 of the present invention provides a large projection region and even illumination intensity without light spots. Moreover, heat generated by the LED light source module 22 can be dissipated through the heat-dissipating base wall 28, the heat-dissipating peripheral wall 27, and the heat-dissipating connecting walls 29, thus dissipating heat effectively.

What is claimed is:

1. A waterproof lighting fixture comprising:

a tubular transparent enclosure extending along an axial direction, said transparent enclosure having two open ends opposite to each other along the axial direction, said transparent enclosure defining an inner hole therein;

a lamp device disposed in said inner hole of said transparent enclosure, said lamp device including a lamp seat disposed along the axial direction, a LED light source module, a reflector component, a LED driver electrically connected to said LED light source module, and a power cable electrically connected to said LED driver, said lamp seat having a heat-dissipating peripheral wall that is disposed around said lamp seat, that defines a compartment having an upper end opening, that has an inner surface and that extends along the axial direction, a heat-dissipating base wall disposed on said inner surface of said heat-dissipating peripheral wall and having a bottom surface, and at least one heat-dissipating connecting wall connected between said bottom surface of said heat-dissipating base wall and said inner surface of said heat-dissipating peripheral wall and extending along said axial direction, said heat-dissipating base wall partitioning said compartment into an upper compartment portion communicated with said upper end opening and a lower compartment portion, said LED light source module being disposed on and above said heat-dissipating base wall and in said upper compartment portion and extending along the axial direction, said reflector component including a bottom wall having two side edges extending along the axial direction, said bottom wall being formed with at least one through hole permitting said LED light source module to extend therethrough, and two side walls extending respectively and upwardly from and along said two side edges of said bottom wall, each of said side walls having a reflecting surface that faces toward the other of said side walls, said reflecting surfaces of said side walls extending upwardly and inclinedly relative to said bottom wall such that a distance between said reflecting surfaces increases in a direction away from said bottom wall, said LED driver being disposed on said heat-dissipating base wall; and a first waterproof device and a second waterproof device disposed for sealing said open ends of said tubular transparent enclosure, respectively, said power cable extending through said first waterproof device, said lamp device being positioned between said first and second waterproof devices.

2. The waterproof lighting fixture as claimed in claim 1, wherein said lamp seat has a plurality of spaced-apart said heat-dissipating connecting walls, said heat-dissipating connecting walls extending uprightly between said bottom surface of said heat-dissipating base wall and said inner surface of said heat-dissipating peripheral wall and being disposed in said lower compartment portion.

3. The waterproof lighting fixture as claimed in claim 1, wherein said lamp device further comprises a protection cover, said heat-dissipating peripheral wall of said lamp seat having two spaced-apart ends extending along the axial direction, and two slide rail portions disposed respectively at said ends of said heat-dissipating peripheral wall, said protection cover having two slots that respectively and movably engage said slide rail portions, said protection cover covering said LED driver.

4. The waterproof lighting fixture as claimed in claim 1, wherein said LED light source module includes a circuit board disposed on said heat-dissipating base wall and electrically connected to said LED driver, and a plurality of LED light sources disposed on said circuit board and spaced apart from each other along the axial direction, said reflector component being formed with a plurality of said through holes that are circular and that are spaced apart from each other along the axial direction, each of said through holes permitting a respective one of said LED light sources to engage fittingly therein.

5. The waterproof lighting fixture as claimed in claim 4, wherein said lamp device further includes two screws, said bottom wall of said reflector component being further formed with a pair of fastener holes that are spaced apart from each other along the axial direction, said through holes being disposed between said fastener holes, said screws extending respectively through said fastener holes and being threaded into said heat-dissipating base wall to secure said reflector component to said circuit board.

6. The waterproof lighting fixture as claimed in claim 1, wherein said reflecting surfaces of said side walls of said reflector component define an angle therebetween that ranges from 80° to 120°.

7. The waterproof lighting fixture as claimed in claim 6, wherein each of said side walls and said bottom wall of said reflector component has first and second ends opposite to each other along the axial direction, said reflector component further comprising two end walls connected to said side walls and said bottom wall at a respective one of said first and second ends.

8. The waterproof lighting fixture as claimed in claim 7, wherein each of said side walls of said reflector component has a distal edge opposite to said bottom wall, said reflector component further comprising two extension walls each extending horizontally from said distal edge of a respective one of said side walls along the axial direction and away from each other.

* * * * *